US006062521A

United States Patent [19]

Kelley et al.

[11] Patent Number: 6,062,521

[45] Date of Patent: May 16, 2000

[54] TOWEL HOLDER

[76] Inventors: William N. Kelley; Arne A. Jensen, Sr., both of Rte. 2, Box 392, Camdenton, Mo. 65020

[21] Appl. No.: 09/033,703

[22] Filed: Mar. 3, 1998

Related U.S. Application Data

[63] Continuation of application No. 08/825,630, Mar. 31, 1997.

[51] Int. Cl.[7] ..... B42F 13/00

[52] U.S. Cl. ..... 248/339; 248/340; 248/317; 24/3.6; 24/343; 223/85

[58] Field of Search ..... 248/339, 317, 248/340, 215, 305, 682, 690, 692, 691; D23/86, DIG. 1, DIG. 2; 24/3.12, 3.6, 343; 223/88, 87, 95, 85, 84, 97, DIG. 4, DIG. 1

[56] References Cited

U.S. PATENT DOCUMENTS

| | | | |
|---|---|---|---|
| D. 202,316 | 9/1965 | Pehr | D80/8 |
| 2,206,161 | 7/1940 | Cherne | 223/84 |
| 2,264,957 | 12/1941 | Shafarman | 24/199 |
| 2,911,179 | 11/1959 | Hammerly | 248/339 |
| 3,065,946 | 11/1962 | Berkow | 248/317 |
| 3,215,385 | 11/1965 | Rockland | 248/317 |
| 3,692,269 | 9/1972 | Hales | 248/360 |
| 3,790,045 | 2/1974 | Rigel et al. | 223/87 |
| 4,023,762 | 5/1977 | Batts et al. | 248/359 |
| 4,346,825 | 8/1982 | Léger | 223/66 |
| 4,858,871 | 8/1989 | Romano | 248/339 |
| 4,905,952 | 3/1990 | Pinquist | 248/317 |
| 4,943,026 | 7/1990 | Fildan | 248/339 |
| 5,429,284 | 7/1995 | Kolton et al. | 223/85 |
| 5,505,351 | 4/1996 | Najarian | 223/85 |
| 5,626,243 | 5/1997 | Brozak, Jr. | 211/59.1 |

FOREIGN PATENT DOCUMENTS

| | | | |
|---|---|---|---|
| 44934 | 2/1982 | European Pat. Off. | 24/3.6 |
| 95593 | 12/1983 | European Pat. Off. | 24/3.6 |
| 2055571 | 3/1981 | United Kingdom | 223/DIG. 1 |

*Primary Examiner*—Ramon O. Ramirez
*Assistant Examiner*—Kimberly Wood
*Attorney, Agent, or Firm*—Terrance L. Siemens

[57] ABSTRACT

A generally flat holder for clipping to a user's trousers and holding a towel or other fabric object. The holder has a body including an upper section forming a C-shaped hook forming a first gap between opposing ends of the C, and a lower section comprising a frame forming a central opening encircling an upwardly projecting tab. A U-shaped second gap is defined between the tab and the surrounding portion of the frame. The body is generally rigid, but is sufficiently flexible so that the hook and tab may be deflected to increase their respective gaps. Deflection enables the hook to be slipped over the belt or edge of the trousers of a user, and enables the tab to admit passage of a towel or the like into the central opening of the lower section of the body. The tab is configured to maintain engagement with the towel, but readily releases the towel when deflected by manual pressure such that its respective gap is widened. All edges of the body are beveled.

18 Claims, 2 Drawing Sheets

TOWEL HOLDER

REFERENCE TO RELATED APPLICATION

This is a Continuing patent application of Ser. No. 08/825,630, filed Mar. 31, 1997.

BACKGROUND OF THE INVENTION

1. Field of the Invention

The present invention relates to hangers, and more particularly to a hanger comprising a hook for securing the hanger to an environmental object and a tongue for engaging a fabric. The hanger is preferably suspended from the belt of a user and is employed to releasably secure a towel to the belt.

2. Description of the Prior Art

Towels and other absorbent materials are used by people to wipe foreign materials, such as dirt and oil, from their hands and from objects they are using. Towels are also used by people to clean and polish items. During outdoor activities, such as camping and fishing, towels and other absorbent fabrics are used by people to keep hands and equipment clean and dry.

If a towel is laid down by the user, it may become soiled or misplaced. Also, when laid down, the towel may be out of convenient reach of the user. To forestall these problems, people have long attempted to entrap towels in their belts. However, the towel may unexpectedly escape. Towels may be placed within ancillary equipment such as golf bags and tackle boxes. However, the towel may again not be readily available when desired.

The prior art has attempted to address this problem by proposing devices for engaging towels and fabrics. U.S. Pat. Nos. 3,692,269, issued to Paul N. Hales on Sep. 19, 1972, and 4,346,825, issued to Jean-Paul Léger on Aug. 31, 1982, are exemplary. Each holder has a hook disposed at the top of the respective device and a tab disposed within an opening for securing a fabric object. The present invention includes such features, but differs in that the hook is nearly closed, the tab cooperates closely with its opening, and in that the edges of the holder are beveled or rounded.

U.S. Pat. Nos. 3,790,045, issued to Yehoshua Rigel et al. on Feb. 5, 1974, 4,943,026, issued to Gerhard Fildan on Jul. 24, 1990, 5,429,284, issued to Chester Kolton et al. on Jul. 4, 1995, and 5,505,351, issued to John Najarian on Apr. 9, 1996, further illustrate garment and package holders. Although the subject inventions include a hook for hanging and a tab for engaging an article to be supported, they differ in configuration from the present invention.

None of the above inventions and patents, taken either singly or in combination, is seen to describe the instant invention as claimed.

SUMMARY OF THE INVENTION

The present invention provides a compact towel holder of generally nominal thickness which has a hook for hanging the holder on a belt or trousers of the user, and a centrally located tab occupying a central opening, for engaging a towel. The holder is sufficiently rigid as to maintain its configuration, but will deflect under manual pressure to allow the hook to be passed over a belt and to allow the tab to pass a towel into the central opening.

The novel holder is readily slid into place on the garments of the user. The hook is C-shaped, so that it substantially encircles a belt. A towel is readily inserted into engagement with the tab, but resists inadvertent dislodging and consequent loss. The towel passes over an end of the tab and is retained by the holder in the following manner. Should the towel be pulled in a direction opposite that of insertion, the tab will resiliently deflect in a manner assuring obstruction to passage of the towel. Pulling on the towel from the opposite direction causes the towel to push the tab aside at its free end, thereby effecting easy removal of the towel from the holder. In summary, once partially inserted through the holder, the towel cannot be easily withdrawn by pulling downwardly, yet is readily removed by pulling upwardly. Thus, the novel holder is readily utilized by sports enthusiasts and others undertaking activities requiring that a towel be close at hand and readily released for use.

The novel holder is generally flat for compactness, the hook and tab deviating from the generally planar configuration only when being manually deflected for mounting and dismounting from the belt and to accept and release a towel. In addition to securely yet releasably holding a towel, the novel holder is readily fabricated by molding from a synthetic resin. Some edges of the holder are rounded to avoid binding and for ease of manufacturing, other edges being beveled for ease of manufacturing by molding. The overall configuration, when viewed in plan, is nearly rectangular and devoid of projections which could readily snag external objects. Broad, flat surfaces are present for bearing molded indicia for advertising, product identification, and other purposes.

Accordingly, it is one object of the invention to provide a holder which is easily attached to the belt or trousers of the user, and which securely holds a towel.

It is another object of the invention that the holder be compact and free from snagging external objects.

It is a further object of the invention that the hook form a nearly closed figure, for encircling belts.

Still another object of the invention is that the holder be compact.

Another object of the invention is that edges of the holder be rounded or beveled for ease of manufacture.

Still another object of the invention is that the holder be formed as a single molded, monolithic piece.

Yet another object of the invention is that the holder accept molded indicia for advertising and other purposes.

An additional object of the invention is that the holder normally remain flat and generally planar, deviating from this configuration only under manual pressure when installing on and releasing a belt, or when accepting and releasing a towel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
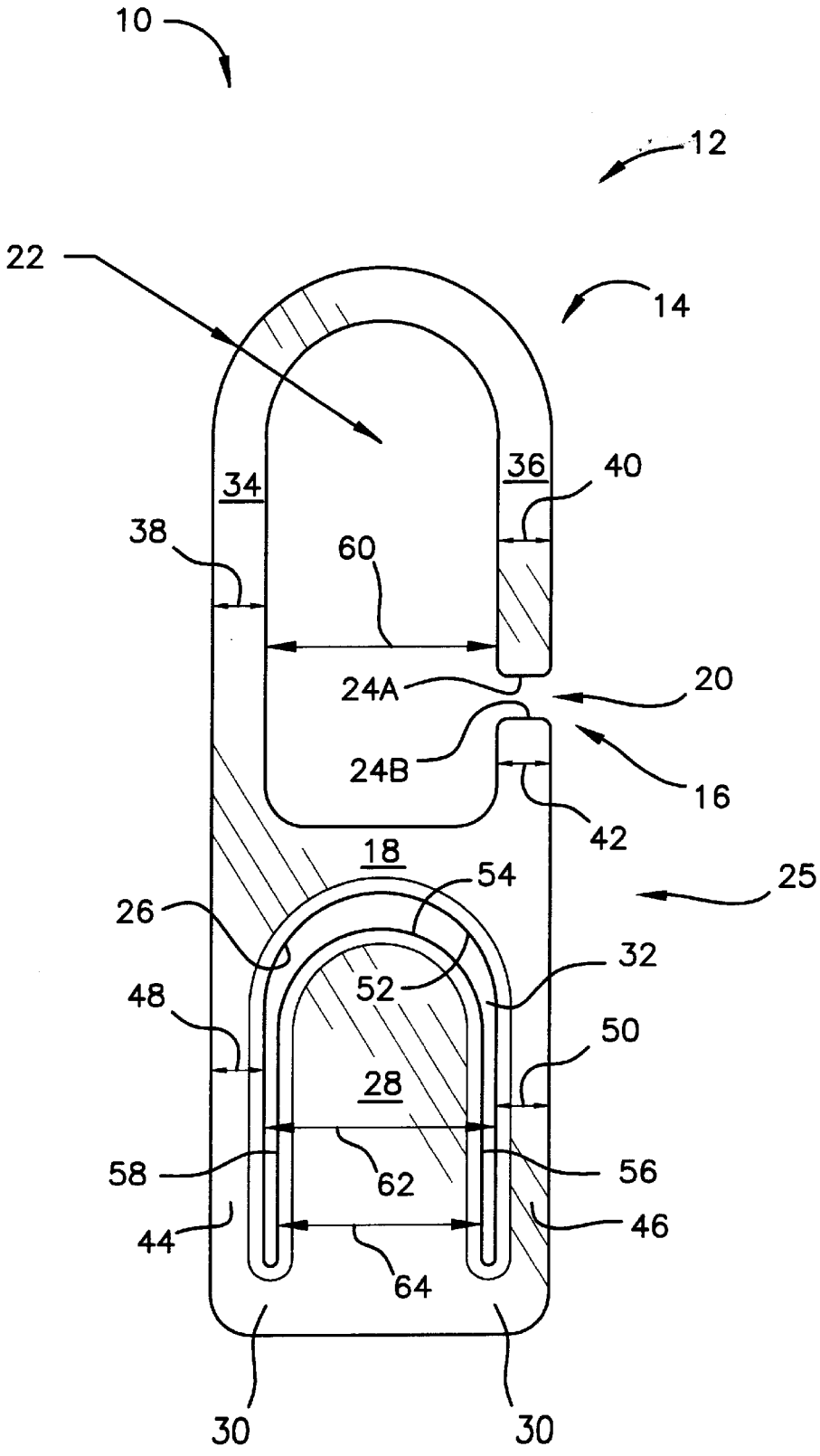
FIG. 1 is a plan view of the invention.
Figure 2:
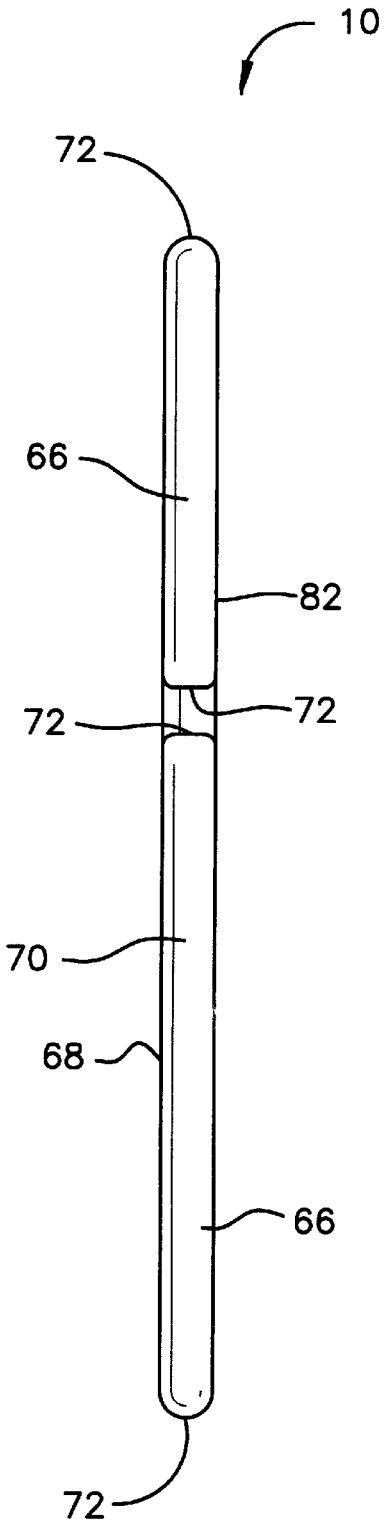
FIG. 2 is an end elevational view of the invention, drawn to reduced scale.

Turning now to FIG. 1 of the drawings, novel holder 10 for securing a fabric object (not shown) to apparel (not shown) of a user comprises a flat body of nominal thickness. Holder 10 has a front face 80 and a rear face 82. These are best seen in FIG. 2. The constituent material of holder 10 is sufficiently rigid to maintain its configuration against spontaneous slumping or deforming, and is sufficiently flexible to deflect under manual pressure. The body of holder 10 has an elongated hook 12 formed at its upper section. Hook 12 includes a first hook member 14, a short second hook member 16, a bottom portion 18, and a gap 20 separating hook members 14, 16. Gap 20 is preferably located on a right or left lateral side of the body of holder 10, to assure retention when slipped over a belt (not shown) of a user. Hook member 14 extends upwardly from bottom portion 18, arches over elongated opening 22 defined within the space encircled by hook members 14, 16, and projects downwardly to approach hook member 16. Hook members 14, 16 terminate at respective tips 24A, 24B.

A frame 25 is joined to hook 12 below bottom portion 18. Frame 25 encloses a second opening 26. A tab 28 occupying opening 26 is anchored to frame 25 at 30. Frame 25 and tab 28 cooperate to establish a second inverted, U-shaped gap 32 existing between frame 25 and tab 28. Opening 26 will generally be coextensive with gap 32 under normal conditions. However, deflection of tab 28 (discussed hereinafter, with reference to FIG. 3), will cause opening 26 to be enlarged, thereby allowing a towel to pass easily through opening 26.

It is preferred that certain dimensions of various portions of holder 10 be maintained equal to each other. Notably, hook members 14, 16 of hook 14 are of constant width. Hook member 14 has a straight left hook section 34 and a straight right hook section 36 parallel to straight left hook section 34. Sections 34 and 36 are of widths 38, 40 substantially identical widths 38, 40. Hook member 16 has a width 42 substantially equal to widths 38, 40.

Frame 25 has a left frame section 44 and a right frame section 46 parallel to one another. Width 48 of left frame section 44 and width 50 of right frame section 46 are substantially identical to one another, as well as to widths 38 and 40. Frame 25 further has a curved upper interior edge 52 defining the top of opening 26. Tab 28 has a correspondingly curved upper edge 54 arranged parallel to edge 52. Tab 28 also has a right edge 56 disposed parallel to right frame section 46 and a left edge 58 disposed parallel to left frame section 44. The overall widths 60, 62 (respectively) of openings 22 and 26 are also substantially identical. The width 64 of tab 28 is such that the magnitude of gap 32 is minimal, thereby assuring that even a single thickness of fabrics typical of towels and apparel will readily become pinched when inserted through gap 32. Advantages of equal widths of hook members 14, 16 and of members of frame 25 are that fabrication of suitable molds is rendered easier, and also that strength and flexibility of the body of holder 10 are constant and predictable.

Tab 28 preferably projects upwardly, as depicted in the drawings. This signifies that upper edge 54 is that part of tab 28 is located relatively close to hook 12. This arrangement assures that a towel can be conveniently pulled upwardly when holder 10 is installed on the user's belt. Also, a towel inserted into engagement with holder 10 will not be casually removed merely by pulling, as will be further described hereinafter.

FIG. 2 shows two characteristics of holder 10. One is that under normal conditions, when holder 10 is not being manipulated to install the same on and remove the same from a belt, nor to engage or release a towel, it is generally flat and planar, apart from nominal thickness of the constituent material. The other characteristic is that all members described prior as having widths have edges 66 disposed between front and lateral surfaces 68, 66 (respectively) and between rear and lateral surfaces 70, 66 (respectively). Edges 66 are characterized by gradual transition between adjacent lateral, front, and rear surfaces 66, 68, 70. This may be accomplished by rounding or curving of edges 66, as particularly pointed out at 72. Alternatively, edges may include facets or faces arranged at progressively increasing pitch to one another to the same effect. Rounding is preferred. Regardless of how it is achieved, the gradual transition eliminates sharp edges (not shown) on which a towel or other fabric might bind. Successful release of the towel is thereby assured.

Figure 3:
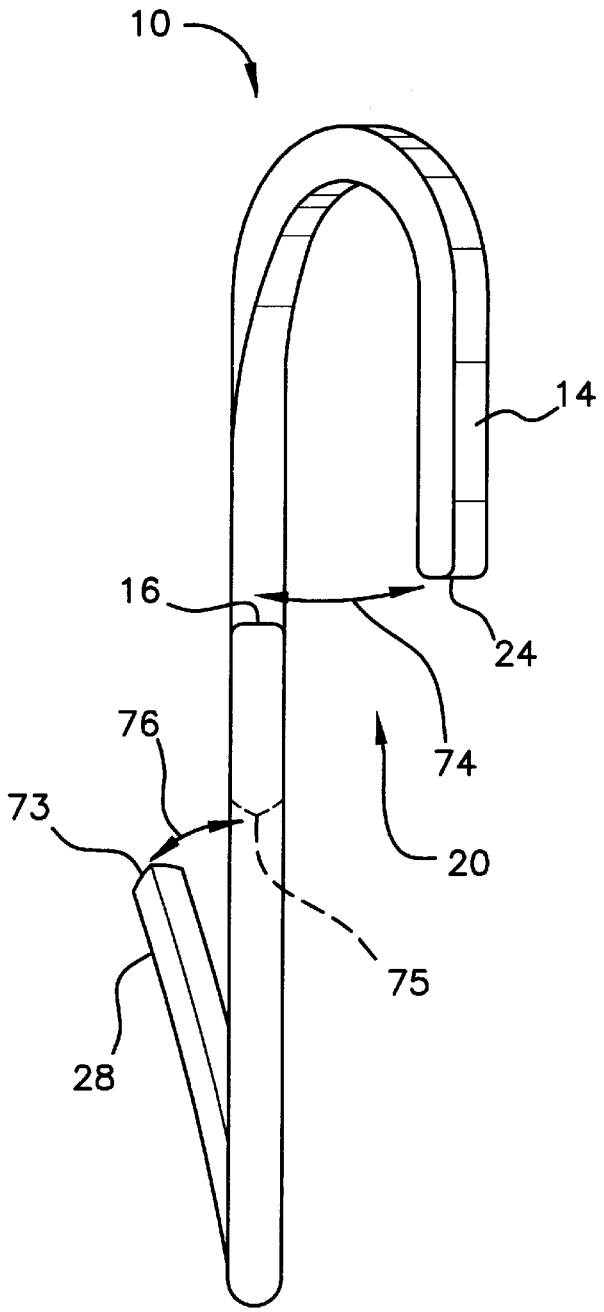
FIG. 3 is an end elevational view of the invention, showing deflection of certain components, but otherwise similar to FIG. 2.

FIG. 3 illustrates how hook member 14 and tab 28 deflect under manual pressure. When first installing holder 10 on a belt, hook member 14 is bent under manual pressure so that tip 24 swings away from hook member 16 as shown by arrow 74, thereby opening gap 20. The additional space thus temporarily afforded enables holder 10 to be slipped over the belt. The belt will then be contained within opening 22, and is most unlikely to spontaneously or inadvertently be dislodged from engagement with holder 10.

FIG. 3 also illustrates that external edges 73 of tab 28 and internal edges 75 of frame 25 are beveled or tapered on both sides to an edge. Beveling or tapering both improves ease of manufacturing, and also establishes a sharp edge which will tend to engage a towel should the towel be pulled downwardly. Therefore, sharp edge 73 assists in retaining a towel.

To install a towel, the towel may be passed through opening 26, thereby deflecting tab 28 in the direction of arrow 76. Once a limited amount of fabric has passed through opening 26, holder 10 is released. Tab 28 resiliently returns to the configuration of FIG. 2, and the towel is retained by pinching. Any attempt to release the towel by pulling the same downwardly will be thwarted. The direction of pull is such that tab 28 resiliently opposes displacement shown in FIG. 3. When the user desires to release the towel, the towel is pulled in an upward direction. This will cause the towel to urge tab 28 into the deflected position shown in FIG. 3. The remaining portion of the towel may then readily be pulled free of holder 10.

It is to be understood that the present invention is not limited to the embodiments described above, but encompasses any and all embodiments within the scope of the following claims.

We claim:

1. A holder for securing a fabric object to a piece of apparel of a user, said holder comprising a flat body of nominal thickness having front and rear sides, said body comprising:

a hook having a bottom member, a first hook member projecting upwardly from said bottom member and forming an arch, said first hook member terminating in a first tip projecting downwardly from said arch, said first hook member further comprising a straight left hook section connecting said bottom member and said arch and further comprising a straight right hook section connecting said arch and said first tip, said straight right hook section and said straight left hook section being parallel in relation to one another, a second hook member terminating at a second tip, and a first gap disposed between said first tip and said second tip, said first hook member and said second hook member encircling a first opening therebetween; and a frame joined to said bottom member of said hook, said frame enclosing a second opening; and a tab having an edge, said tab being anchored to said frame and projecting into said second opening to thereby define a second gap between said frame and said tab; wherein said edge of said tab is tapered from both front and rear sides to increase friction between the edge of the tab and the fabric object, to thereby more firmly secure the fabric object within said second gap.

2. The holder according to claim 1, wherein said straight left hook section, said arch, said straight right hook section and said second hook member are all of equal width.

3. The holder according to claim 2, wherein said first hook member, said second hook member and said frame each include:

a front surface;

a rear surface;

lateral surfaces; and rounded edges disposed between said front surface, said rear surface and said lateral surfaces.

4. The holder according to claim 3, wherein said frame includes a left frame section and a right frame section parallel to said left frame section, said left and right frame sections having equal widths.

5. The holder according to claim 4, wherein:

said frame further includes a curved upper interior edge;

said left frame section includes a right interior edge;

said right frame section includes a left interior edge;

said edge of said tab includes a right edge parallel to said left interior edge of said right frame section, a left edge parallel to said right interior edge of said left frame section, and a curved upper edge parallel to said curved upper interior edge of said frame; and said curved upper interior edge, said right interior edge and said left interior edge are all tapered from both front and rear sides, to thereby more firmly secure the fabric object within said second gap.

6. The holder according to claim 5, wherein:

said left frame section, said right frame section, said straight left hook section, said arch, said straight right hook section and said second hook member are all of equal width; and said first opening and said second opening are of equal width.

7. A holder for securing a fabric to a piece of apparel of a user, said holder comprising a flat body of nominal thickness having front and rear sides, said body being in a plane and comprising:

a hook having a bottom member, a first hook member projecting upwardly from said bottom member and forming an arch, said first hook member terminating in a first tip projecting downwardly from said arch, said first hook member further comprising a straight left hook section connecting said bottom member and said arch and further comprising a straight right hook section connecting said arch and said first tip, said straight right hook section and said straight left hook section being parallel in relation to one another, a second hook member terminating at a second tip, and a first gap disposed between said first tip and said second tip, said first hook member and said second hook member encircling a first opening therebetween; and a frame joined to said bottom member of said hook, said frame enclosing a second opening; and a tab, said tab being anchored to said frame and projecting into said second opening to thereby define a second gap between said frame and said tab and where said tab further includes an edge, said edge being tapered from both front and rear sides to increase friction between the edge of the tab and the fabric object, to thereby more firmly secure the fabric object within said second gap; wherein said first hook member has a first non-flexed position wherein said first hook member is in said plane and a first flexed position wherein said hook member extends out of said plane;

said tab has a second non-flexed position wherein said tab is in said plane, and a second flexed position wherein said tab extends out of said plane;

wherein said first hook member is attached to the apparel of the user by bending said first hook member into said first flexed position, placing said first hook member about the apparel, and releasing said first hook member to return said first hook member to said first non-flexed position, thereby trapping the apparel within said first opening; and wherein said tab is adapted to be attached to the fabric object by bending said tab into said second flexed position, placing the fabric object through said second gap, and releasing said tab to return said tab to said second non-flexed position, said tab thereby holding the fabric object in said second gap.

8. The holder according to claim 7, wherein said straight left hook section, said arch, said straight right hook section and said second hook member are all of equal width.

9. The holder according to claim 8, wherein said first hook member, said second hook member and said frame each include:

a front surface;

a rear surface;

lateral surfaces; and rounded edges disposed between said front surface, said rear surface and said lateral surfaces.

10. The holder according to claim 9, wherein said frame includes a left frame section and a right frame section parallel to said left frame section, said left and right frame sections having equal widths.

11. The holder according to claim 10, wherein:

said frame further includes a curved upper interior edge;

said left frame section includes a right interior edge;

said right frame section includes a left interior edge;

said edge of said tab includes a right edge parallel to said left interior edge of said right frame section, a left edge parallel to said right interior edge of said left frame section, and a curved upper edge parallel to said curved upper interior edge of said frame; and said upper curved interior edge, said right interior edge and said left interior edge are all tapered from both front and rear sides, to thereby more firmly secure the fabric object within said second gap.

12. The holder according to claim 11, wherein:

said left frame section, said right frame section, said straight left hook section, said arch, said straight right hook section and said second hook member are all of equal width; and said first opening and said second opening are of equal width.

13. A holder for securing a fabric to a piece of apparel of a user, said holder comprising a flat body of nominal thickness having front and rear sides, said body being in a plane and comprising:

a hook having a bottom member, a first hook member projecting upwardly from said bottom member and forming an arch, said first hook member terminating in a first tip projecting downwardly from said arch, said first hook member further comprising a straight left hook section connecting said bottom member and said arch and further comprising a straight right hook section connecting said arch and said first tip, said straight right hook section and said straight left hook section being parallel in relation to one another, a second hook member terminating at a second tip, and a first gap disposed between said first tip and said second tip, said first hook member and said second hook member encircling a first opening therebetween; and a frame joined to said bottom member of said hook, said frame enclosing a second opening; and a continuous tab, said tab being anchored to said frame and protecting into said second opening to thereby define a single inverted U-shaped second gap between said frame and said tab and where said tab further includes an edge, said edge being tapered from both front and rear sides to increase friction between the edge of the tab and the fabric object, to thereby more firmly secure the fabric object within said second gap; wherein said tab has a non-flexed position wherein said tab is in said plane, and a flexed position wherein said tab extends out of said plane; and wherein said holder is adapted to be attached to the fabric object by bending said tab into said flexed position, placing the fabric object through said inverted U-shaped gap, and releasing said tab to return said tab to said non-flexed position, thereby holding the fabric object in said inverted U-shaped gap.

14. The holder according to claim 13, wherein said straight left hook section, said arch, said straight right hook section and said second hook member are all of equal width.

15. The holder according to claim 14, wherein said first hook member, said second hook member and said frame each include:

a front surface;

a rear surface;

lateral surfaces; and rounded edges disposed between said front surface, said rear surface and said lateral surfaces.

16. The holder according to claim 15, wherein said frame includes a left frame section and a right frame section parallel to said left frame section, said left and right frame sections having equal widths.

17. The holder according to claim 16, wherein:

said frame further includes a curved upper interior edge;

said left frame section includes a right interior edge;

said right frame section includes a left interior edge;

said edge of said tab includes a right edge parallel to said left interior edge of said right frame section, a left edge parallel to said right interior edge of said left frame section, and a curved upper edge parallel to said curved upper interior edge of said frame; and said curved interior edge, said right interior edge and said left interior edge are all tapered from both said front and said rear sides, to thereby more firmly secure the fabric object within said second gap.

18. The holder according to claim 17, wherein:

said left frame section, said right frame section, said straight left hook section, said arch, said straight right hook section and said second hook member are all of equal width; and said first opening and said second opening are of equal width.

* * * * *